US009036325B2

(12) United States Patent
Tojo et al.

(10) Patent No.: US 9,036,325 B2
(45) Date of Patent: May 19, 2015

(54) ION WIND GENERATOR AND ION WIND GENERATING DEVICE

(75) Inventors: Tetsuya Tojo, Kyoto (JP); Takashige Yagi, Kyoto (JP); Hiroshi Makino, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 313 days.

(21) Appl. No.: 13/805,627

(22) PCT Filed: Aug. 18, 2011

(86) PCT No.: PCT/JP2011/068696

§ 371 (c)(1),
(2), (4) Date: Dec. 19, 2012

(87) PCT Pub. No.: WO2012/023586

PCT Pub. Date: Feb. 23, 2012

(65) Prior Publication Data

US 2013/0088807 A1 Apr. 11, 2013

(30) Foreign Application Priority Data

Aug. 18, 2010 (JP) ..... 2010-183174

(51) Int. Cl.
*H01T 23/00* (2006.01)
*H05F 3/00* (2006.01)

(52) U.S. Cl.
CPC ..... *H01T 23/00* (2013.01)

(58) Field of Classification Search
CPC ..... H01T 23/00; H05F 3/04; H05F 3/06
USPC ..... 361/230, 231
See application file for complete search history.

(56) References Cited

U.S. PATENT DOCUMENTS 4,672,503 A * 6/1987 Masuda et al. ..... 361/230
4,922,099 A * 5/1990 Masuda et al. ..... 250/324

(Continued)

FOREIGN PATENT DOCUMENTS

JP H08310801 A 11/1996
JP 2005-216763 8/2005

(Continued)

OTHER PUBLICATIONS

Extended European search report dated Sep. 24, 2014 issued in corresponding European application 11818227.8.

*Primary Examiner* — Thienvu Tran
*Assistant Examiner* — Christopher Clark
(74) *Attorney, Agent, or Firm* — Volpe and Koenig, P.C.

(57) ABSTRACT

Provided is an ion wind generator capable of suitably generating an ion wind along the surface of a dielectric. An ion wind generator has: a dielectric having a first primary surface and a second primary surface at the rear thereof; an inner side electrode arranged in the dielectric; a first electrode arranged on the first primary surface side with respect to the inner side electrode; and a second electrode arranged on the second primary surface side with respect to the inner side electrode. The inner side electrode has a first downstream area located in a first direction (the positive side of x-axis direction) along the first primary surface with respect to the first electrode, and a second downstream area located in a second direction (the positive side of x-axis direction) along the second primary surface with respect to the second electrode.

3 Claims, 8 Drawing Sheets

(56) References Cited

U.S. PATENT DOCUMENTS

| | | | | |
|---|---|---|---|---|
| 7,485,265 | B2 * | 2/2009 | Park et al. | 422/186.04 |
| 8,929,049 | B2 * | 1/2015 | Yagi et al. | 361/231 |
| 2005/0231884 | A1 * | 10/2005 | Miyaishi et al. | 361/231 |
| 2007/0277667 | A1 * | 12/2007 | Dunn-Rankin et al. | 84/677 |
| 2009/0207548 | A1 * | 8/2009 | Seto et al. | 361/231 |
| 2011/0198312 | A1 * | 8/2011 | Tanaka et al. | 216/13 |
| 2011/0216467 | A1 * | 9/2011 | Itani | 361/231 |
| 2013/0083446 | A1 * | 4/2013 | Yagi et al. | 361/231 |
| 2013/0119264 | A1 * | 5/2013 | Yagi et al. | 250/423 R |

FOREIGN PATENT DOCUMENTS

| | | | |
|---|---|---|---|
| JP | 2007-317656 | | 12/2007 |
| JP | 2009-030699 | | 2/2009 |
| WO | 0102291 | A2 | 1/2001 |
| WO | 2010074654 | A1 | 7/2010 |

* cited by examiner

ION WIND GENERATOR AND ION WIND GENERATING DEVICE

TECHNICAL FIELD

The present invention relates to an ion wind generator and an ion wind generating device.

BACKGROUND ART

Known in the art is a device which induces an ion wind by movement of electrons or ions. For example, in Patent Literature 1, an AC voltage is applied to two electrodes provided on a substrate-shaped dielectric to generate a dielectric barrier discharge and thereby an ion wind is generated on one primary surface of the dielectric.

CITATIONS LIST

Patent Literature

Patent Literature 1: Japanese Patent Publication No. 2007-317656 A1

SUMMARY OF INVENTION

Technical Problem

Patent Literature 1 takes note of only generation of an ion wind on one primary surface of a substrate-shaped dielectric and does not take note of the influence of the two electrodes exerted upon other surfaces of the dielectric such as the other primary surface or the like. As a result, for example, an ion wind which is not intended to be generated and is in an opposite direction to that on the one primary surface is induced at the other primary surface. This reduces the air flow of the ion wind on the one primary surface, so the required function is not exhibited.

Accordingly, desirably there is provided an ion wind generator and an ion wind generating device capable of suitably generating an ion wind along the surface of a dielectric.

Solution to Problem

An ion wind generator according to one aspect of the present invention has a dielectric which has a first surface and a second surface which face directions different from each other, an inner side electrode which is arranged in the dielectric, a first electrode which is arranged on the first surface side with respect to the inner side electrode, and a second electrode which is arranged on the second surface side with respect to the inner side electrode. The inner side electrode has a first downstream area located in a first direction along the first surface with respect to the first electrode and can induce an ion wind along the first surface by application of voltage with the first electrode and has a second downstream area located in a second direction along the second surface with respect to the second electrode and can induce an ion wind along the second surface by application of voltage with the second electrode.

An ion wind generating device according to one aspect of the present invention has a dielectric having a first surface and a second surface which face directions different from each other, an inner side electrode arranged the dielectric, a first electrode arranged on the first surface side with respect to the inner side electrode, a second electrode arranged on the second surface side with respect to the inner side electrode, and a power supply supplying voltage between the inner side electrode and the first electrode and supplying voltage between the inner side electrode and the second electrode. The inner side electrode has a first downstream area located in a first direction along the first surface with respect to the first electrode and can induce an ion wind along the first surface by application of voltage with the first electrode and has a second downstream area located in a second direction along the second surface with respect to the second electrode and can induce an ion wind along the second surface by application of voltage with the second electrode.

Advantageous Effects of Invention

According to the above configurations, ion wind along the surface of the dielectric can be suitably generated.

DESCRIPTION OF EMBODIMENTS

Below, ion wind generators and ion wind generating devices according to several embodiments of the present invention will be explained with reference to the drawings. Note that, the drawings used in the following explanation are schematic ones. Dimensions, ratios, etc. on the drawings do not always coincide with the actual ones.

Further, in the second and following embodiments, with regard to the configurations common or similar to those in the already explained embodiments, notations common to those in the already explained embodiments will be used, and illustration and explanation will be sometimes omitted.

First Embodiment

Figure 1A:
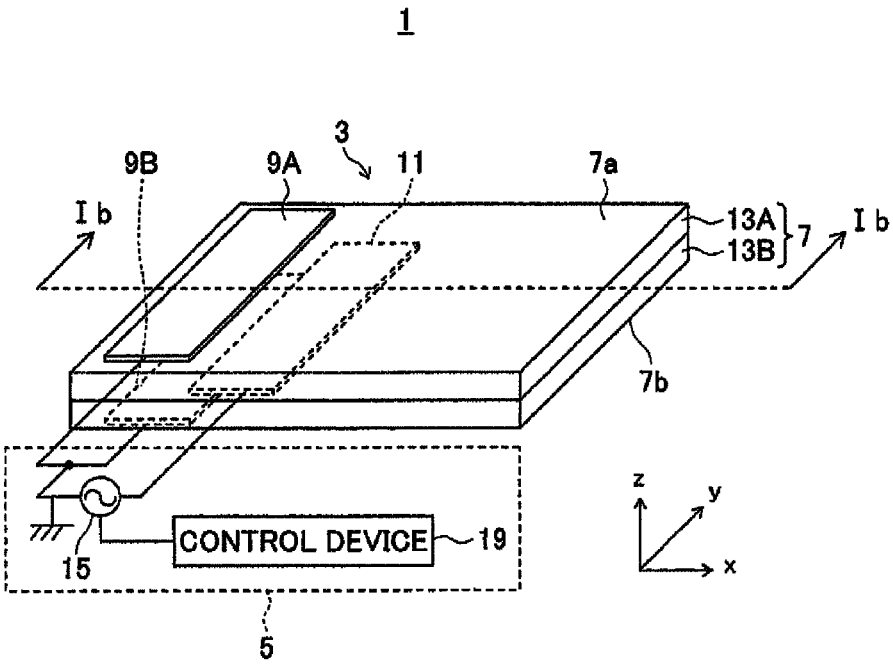
FIG. 1A is a perspective view which schematically shows an ion wind generating device according to a first embodiment of the present invention.
Figure 1B:
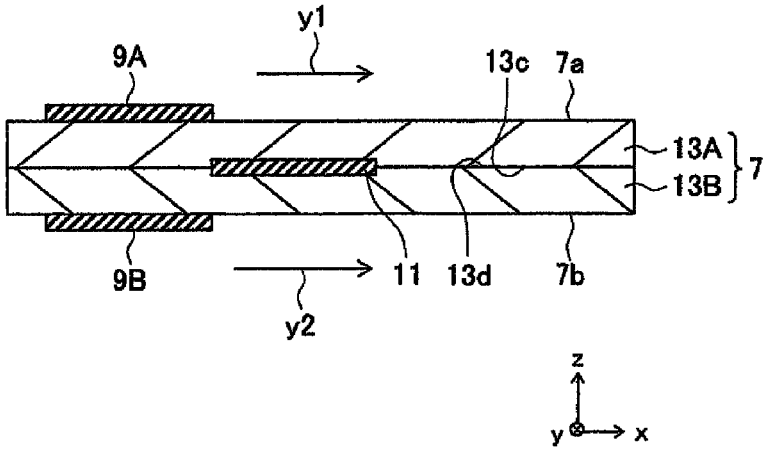
FIG. 1B is a cross-sectional view along an Ib-Ib line in FIG. 1A.

FIG. 1A is a perspective view schematically showing an ion wind generating device 1 according to a first embodiment of the present invention, and FIG. 1B is a cross-sectional view along an Ib-Ib line in FIG. 1A.

The ion wind generating device 1 is configured as a device for generating ion winds which flow in directions indicated by arrows y1 and y2 (FIG. 1B). Note that, in the present embodiment, sometimes a direction in which the ion wind flows will be referred to as an "x-direction", a width direction of the ion wind will be referred to as a "y-direction", and a height direction of the ion wind will be referred to as a "z-direction".

The ion wind generating device 1 has an ion wind generator 3 for generating an ion wind and a drive part 5 (FIG. 1A) for driving and controlling the ion wind generator 3.

The ion wind generator 3 has a dielectric 7 and a first electrode 9A and a second electrode 9B and an inner side electrode 11 which are provided around the dielectric 7. Note that, in the following description, sometimes the first electrode 9A and the second electrode 9B will be referred to as the "outer side electrodes 9" and the two will not be distinguished. The ion wind generator 3, by application of voltage between the outer side electrode 9 and the inner side electrode 11 which are isolated by the dielectric 7, generates a dielectric barrier discharge and generates ion wind.

The dielectric 7 is for example formed in a flat sheet shape (substrate shape) having a constant thickness and has a first primary surface 7*a* and a second primary surface 7*b* at the back thereof. Note that, the ion wind flows as indicated by an arrow y1 on the first primary surface 7*a* along the first primary surface 7*a* and flows as indicated by an arrow y2 on the second primary surface 7*b* along the second primary surface 7*b*. Further, the ion wind flowing on the first primary surface 7*a* and the ion wind flowing on the second primary surface 7*b* flow in the same direction as each other (x-direction). The planar shape of the dielectric 7 may be a suitable shape, but FIG. 1 exemplifies a case where it is formed as rectangle having sides parallel in the x-direction and sides parallel in the y-direction.

The dielectric 7 is for example configured by lamination of a first insulation layer 13A and a second insulation layer 13B (hereinafter sometimes simply referred to as the "insulation layers 13" and the two will not be distinguished). Note that, in FIG. 1, for convenience of explanation, a borderline between the first insulation layer 13A and the second insulation layer 13B is clearly shown. However, in the actual product, the first insulation layer 13A and second insulation layer 13B may be integrally formed and the borderline not be observable. Note that, even if the borderline cannot be observed, as will be understood from the later explanation, it is possible to identify its position from the position of the inner side electrode 11.

The insulation layers 13 are formed in for example flat sheet shapes having constant thicknesses. The first insulation layer 13A has a first primary surface 7*a* and a third primary surface 13*c* (FIG. 1B) at the rear thereof. The second insulation layer 138 has a second primary surface 7*b* and a fourth primary surface 13*d* (FIG. 1B) at the rear thereof. The thicknesses of the two insulation layers 13 are made the same as each other in the present embodiment. Further, the planar shapes of the two insulation layers 13 are for example made the same as each other. Note that, each of the insulation layers 13 may be formed by a plurality of insulation layers as well.

The dielectric 7 (insulation layers 13) may be formed by an inorganic insulating material or may be formed by an organic insulating material. As inorganic insulating materials, for example, there can be mentioned ceramic and glass. As the ceramic, for example, there can be mentioned an aluminum oxide sintered body (alumina ceramics), glass ceramic sintered body (glass ceramic), mullite sintered body, aluminum nitride sintered body, cordierite sintered body, and silicon carbide sintered body. As the organic insulating material, for example, there can be mentioned a polyimide, epoxy, and rubber.

The first electrode 9A is laid on the first primary surface 7*a*, the second electrode 98 is laid on the second primary surface 7*b*, and the inner side electrode 11 is arranged between the two insulation layers 13. In other words, the inner side electrode 11 is arranged in the dielectric 7, the first electrode 9A is arranged on the first primary surface 7*a* side with respect to the inner side electrode 11, and the second electrode 9B is arranged on the second primary surface 7*b* side with respect to the inner side electrode 11. Due to this, these electrodes are isolated by the dielectric 7.

The two outer side electrodes 9 are for example set the same in shape and position other than the position in the thickness direction (z-direction). That is, the two outer side electrodes 9 are formed in shapes the same as each other. Their positions in the flow direction (x-direction) and width direction (y-direction) are the same as each other. This is because the air flow etc. are made the same on the first primary surface 7*a* side and on the second primary surface 7*b* side.

The inner side electrode 11 includes a first downstream area (the whole of the inner side electrode 11 in the present embodiment) located on the downstream side in the flow direction (the positive side of the x-direction and the first direction along the first primary surface 7*a*) with respect to the first electrode 9A. Due to this, induction of an ion wind having the first electrode 9A side as the upstream side becomes possible. In the same way, the inner side electrode 11 includes a second downstream area (the whole of the inner side electrode 11 in the present embodiment) located on the downstream side in the flow direction (the positive side of the x-direction and the second direction along the second primary surface 7*b*) with respect to the second electrode 9B. Due to this, induction of an ion wind having the second electrode 9B side as the upstream side becomes possible.

In other words, the inner side electrode 11 is arranged offset in position in the flow direction (positive side of the x-direction) with respect to the outer side electrodes 9. Due to this offset, induction of an ion wind having the outer electrodes 9 side as the upstream side and having the inner side electrode 11 side as the downstream side has become possible.

In the present embodiment, when viewing the first primary surface 7*a* or second primary surface 7*b* from a plane, in the x-direction, the inner side electrode 11 is adjacent to the outer side electrodes 9 without a gap. Note, in the inner side electrode 11, when viewing the first primary surface 7*a* or second primary surface 7*b* from a plane, in the x-direction, a portion of the upstream side may overlap the whole or a portion of the downstream side of the outer side electrodes 9 (the downstream area may be a portion of the inner side electrode 11) or the inner side electrode 11 may be separated from the outer side electrodes 9 with a predetermined gap.

In other words, when viewing the first primary surface 7*a* or second primary surface 7*b* from a plane, in the x-direction, the outer side electrodes 9 and the inner side electrode 11 may be offset so that the inner side electrode 11 overlaps a portion of the outer side electrodes 9 or may be offset so that the inner side electrode 11 overlaps the entire outer side electrodes 9. Further, when viewing the first primary surface 7*a* or second primary surface 7*b* from a plane, in the x-direction, the outer side electrodes 9 and the inner side electrode 11 may be offset so that they are adjacent without a gap or may be completely offset (separated with a predetermined gap).

As explained above, the thicknesses of the two insulation layers 13 are the same as each other, therefore the distance between the first electrode 9A and the inner side electrode 11 and the distance between the second electrode 9B and the inner side electrode 11 in the thickness direction (z-direction) are the same. Further, the positions of the two outer side electrodes 9 in the flow direction (x-direction) are the same as each other, therefore the distance between the first electrode 9A and the inner side electrode 11 and the distance between the second electrode 9B and the inner side electrode 11 in the flow direction (x-direction) are the same. Further, from these, the distance between the first electrode 9A and the inner side electrode 11 (first downstream area) and the distance between the second electrode 9B and the inner side electrode 11 (second downstream area) on the xz-plane are the same.

The outer side electrodes 9 and inner side electrode 11 are for example formed in layer shapes (including flat sheet shapes) having constant thicknesses. The planar shapes of these electrodes may be made any suitable shapes. In FIG. 1, however, a case where they are given rectangular shapes each having sides parallel in the x-direction and sides parallel in the y-direction is exemplified. Note that, the lengths in the y-direction of the electrodes 9 and inner side electrode 11 are for example set the same as each other.

The outer side electrodes 9 and inner side electrode 11 are formed by a conductive material such as a metal or the like. As the metal, there can be mentioned tungsten, molybdenum, manganese, copper, silver, gold, palladium, platinum, nickel, cobalt, or alloys containing them as principal ingredients.

The drive part 5 (FIG. 1A) has a power supply device 15 which supplies an AC voltage between the outer side electrodes 9 and the inner side electrode 11 and has a control device 19 which controls the power supply device 15.

Two outer side electrodes 9 are connected in parallel by a wire provided on the dielectric 7 or other wires. Accordingly, the power supply device 15 supplies voltages having voltage values, frequencies, and phases which are the same as each other between the first electrode 9A and the inner side electrode 11 and between the second electrode 9B and the inner side electrode 11.

The AC voltage supplied by the power supply device 15 may be a voltage which is represented by a sine wave etc. and continuously changes in potential or may be a voltage of a pulse type which discontinuously changes in potential. Further, the AC voltage may be a voltage which fluctuates in potential with respect to the reference potential at both of the outer side electrodes 9 and the inner side electrode 11 or may be a voltage which fluctuates in potential with respect to the reference potential in only one of the outer side electrodes 9 and inner side electrode 11 since the other is connected to the reference potential. The potential may fluctuate both positive and negative with respect to the reference potential or may fluctuate to only either positive or negative with respect to the reference potential.

FIG. 1A exemplifies a case where the reference potential is given to the outer side electrode 9, and an AC voltage is supplied so that the potential of the inner side electrode 11 fluctuates. Note that, in the example shown in FIG. 1A, the reference potential is preferably the same as the potential of the ground (reference potential in the narrow sense).

The control device 19 for example controls the ON/OFF application of voltage by the power supply device 15 or the magnitude of the voltage supplied and so on according to a predetermined sequence or operation by the user.

Note that the dimensions of the dielectric 7, outer side electrodes 9, and inner side electrode 11 and the magnitude and frequency of the AC voltage may be suitably set in accordance with the art in which the ion wind generating device 1 is applied or a required nature of the ion wind and other various situations.

Figure 2:
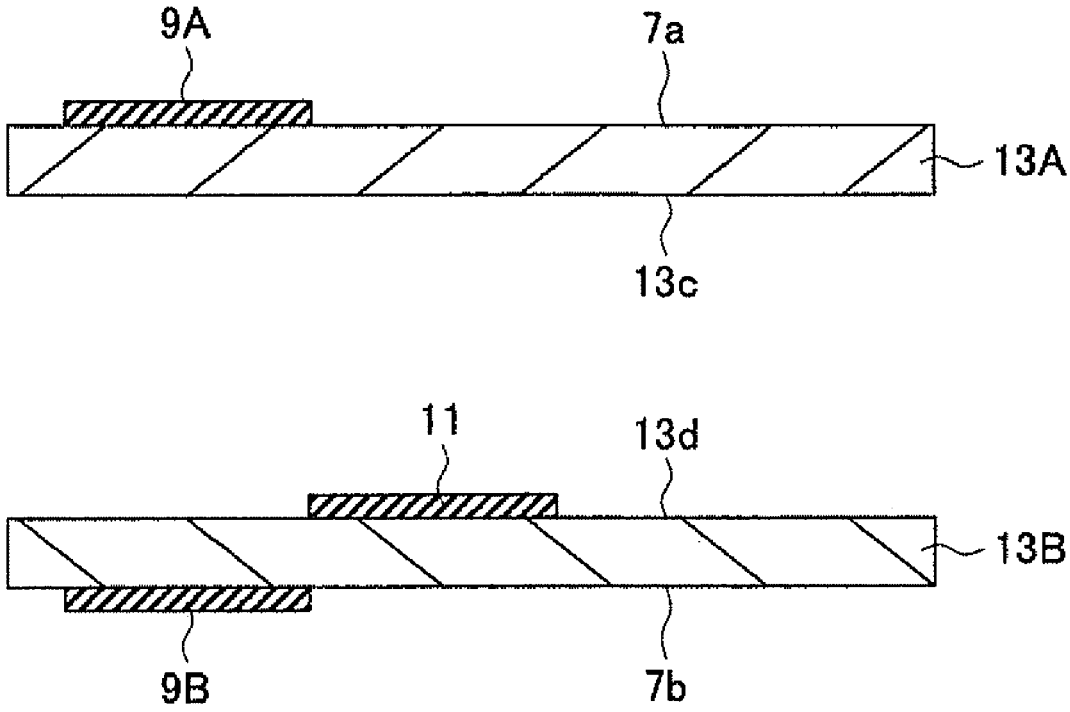
FIG. 2 A cross-sectional view for explaining a method of production of an ion wind generator in FIG. 1.

FIG. 2 is a schematic cross-sectional view for explaining the method of production of the ion wind generator 3.

The dielectric 7 is produced, as shown in FIG. 2, by lamination of the first insulation layer 13A on which the first electrode 9A is provided and the second insulation layer 13B at which the second electrode 9B and the inner side electrode 11 are provided. Specifically, when taking as an example a case where the dielectric 7 is configured by a ceramic sintered body, the method is as follows.

First, a ceramic green sheet which becomes the insulation layer 13 is prepared. The ceramic green sheet is formed by adding and mixing a suitable organic solvent and the other solvent to the base powder to prepare a slurry and molding it into a sheet shape by a doctor blade method, calender roll method, or other molding methods. The base powder is, when taking as an example an alumina ceramic, alumina ($Al_2O_3$), silica ($SiO_2$), calcia (CaO), magnesia, etc.

Next, the conductive paste which becomes the first electrode 9A is provided on the surface which becomes the first primary surface 7*a* of the ceramic green sheet (first insulation layer 13A). Further, the conductive paste which becomes the second electrode 9B is provided on the surface which becomes the second primary surface 7*b* of the ceramic green sheet (second insulation layer 13B), and the conductive paste which becomes the inner side electrode 11 is provided on the surface which becomes a fourth primary surface 13*d*.

The conductive paste is prepared for example by adding and mixing an organic solvent and organic binder to metallic powder such as tungsten, molybdenum, copper, silver or the like. In the conductive paste, according to need, a dispersant, plasticizer, or the like may be added as well. Mixing is carried out by for example a ball mill, triple roll mill, or planetary mixer or other kneading means. Further, the conductive paste is printed on the ceramic green sheet by using for example a screen printing method or other printing means.

Further, the ceramic green sheet which becomes the first insulation layer 13A and the ceramic green sheet which becomes the second insulation layer 13B are laminated, and the conductive pastes and ceramic green sheets are simultaneously fired. Due to this, a dielectric 7 at which the outer side electrodes 9 and inner side electrode 11 are arranged, that is, the ion wind generator 3, is formed.

Note that, when the conductive paste is fired simultaneously with the ceramic green sheet, for matching with the sintering behavior of the ceramic green sheet and raising the bonding strength with the dielectric after sintering by easing, a powder of glass or ceramic may be added to the conductive paste as well.

Next, the action of the ion wind generating device 1 will be explained.

The ion wind generator 3 is placed in the atmosphere so there is air around the ion wind generator 3. Note that, the ion wind generator 3 may be used while placed in a specific type of gas atmosphere (for example in a nitrogen atmosphere).

When voltage is applied between the outer side electrodes 9 and the inner side electrode 11 by the power supply device 15, and the potential difference between these electrodes exceeds a predetermined threshold value, a dielectric barrier discharge occurs. Then, plasma is generated accompanied with discharge.

Electrons or ions in the plasma move by the electric field formed by the outer side electrodes 9 and inner side electrode 11. Further, neutral molecules move accompanied with the electrons or ions as well. The ion wind is induced in this way.

More specifically, the ion wind is, as indicated by the arrows y1 and y2, induced by electrons or ions moving from the side of the outer side electrodes 9 to the side of the inner side electrode 11 centered at the regions at the first primary surface 7*a* and second primary surface 7*b* which overlap the inner side electrode 11 and flows from the side of the outer side electrodes 9 to the side of the inner side electrode 11.

The larger the voltage applied to the outer side electrodes 9 provided at the primary surfaces and the inner side electrode 11 or the smaller the distances between the outer side electrodes 9 provided on the primary surfaces and the inner side electrode 11, the greater the velocity (flow) of the ion wind around the primary surfaces.

In the present embodiment, the first electrode 9A and second electrode 9B are provided under the same conditions as each other except for their positions in the z-direction, and voltages the same as each other are supplied. Therefore, on the first primary surface 7*a* side and on the second primary surface 7*b*, ion winds having directions, velocities, and flows the same as each other are generated.

As described above, in the present embodiment, the ion wind generator 3 has a dielectric 7 having a first primary surface 7*a* and a second primary surface 7*b* at the rear thereof, an inner side electrode 11 arranged in the dielectric 7, a first electrode 9A arranged on the first primary surface 7*a* side with respect to the inner side electrode 11, and a second electrode 9B arranged on the second primary surface 7*b* side with respect to the inner side electrode 11. The inner side electrode 11 has a first downstream area located in a first direction (positive side of x-direction) along the first primary surface 7*a* with respect to the first electrode 9A and has a second downstream area located in a second direction (positive side of x-direction) along the second primary surface 7*b* with respect to the second electrode 9B.

Accordingly, the ion wind along the first primary surface 7*a* can be generated by applying voltage between the inner side electrode 11 and the first electrode 9A, and the ion wind along the second primary surface 7*b* can be generated by applying voltage between the inner side electrode 11 and the second electrode 9B. As a result, for example, by individually adjusting the positional relationship between the inner side electrode 11 and the first electrode 9A and adjusting the positional relationship between the inner side electrode 11 and the second electrode 9B, an ion wind having any direction and flow can be generated at each of the first primary surface 7*a* and second primary surface 7*b*. That is, ion winds can be suitably generated at both surfaces of the dielectric 7. In addition, the inner side electrode 11 is commonly used for the generation of ion wind around the first primary surface 7*a* and the generation of ion wind around the second primary surface 7*b*, therefore the configuration can be simplified and made smaller in size.

The first electrode 9A and the second electrode 9B are offset in the same direction along the first primary surface 7*a* and second primary surface 7*b* with respect to the inner side electrode 11 (the above first direction and second direction are the same direction).

Accordingly, the ion wind generated at the first primary surface 7*a* and the ion wind generated at the second primary surface 7*b* flow in the same direction as indicated by the arrows y1 and y2 in FIG. 1. If paying attention to only generation of the ion wind indicated by the arrow y1 at the first primary surface 7*a* in the same way as the prior art and the second electrode 9B is not provided, an ion wind in an opposite direction to that indicated by the arrow y2 is generated at the second primary surface 7*b* due to the voltage supplied to the first electrode 9A and inner side electrode 11. As a result, the ion wind indicated by the arrow y1 is reduced in velocity and flow. In the present embodiment, however, such an inconvenience is solved.

The dielectric 7 is a substrate configured by lamination of a plurality of (two in the present embodiment) insulation layers 13 of flat sheet shapes. The first primary surface 7*a* and second primary surface 7*b* are the two surfaces of the substrate facing the lamination directions of the plurality of insulation layers 13. The first electrode 9A is a layer shaped electrode laminated on the first primary surface 7*a*. The second electrode 9B is a layer-shaped electrode which is laminated upon the second primary surface 7*b*. The inner side electrode 11 is a layer-shaped electrode which is arranged between any of the layers of the plurality of insulation layers 13.

Accordingly, the ion wind generator 3 has the same configuration as that of a multilayer circuit board. Various techniques used for multilayer circuit boards can be utilized. As a result, for example, it is easy to realize an ion wind generator 3 excellent in mechanical strength, thermal strength, and electrical characteristics, and it is easy to make the production method suitable and reduce the cost.

The dielectric 7 is configured by a ceramic. Accordingly, an ion wind generator 3 excellent in mechanical strength, thermal strength, and electrical characteristics can be realized. Further, as explained with reference to FIG. 2, by simultaneously firing the conductive pastes and ceramic green sheets, an inner side electrode 11 buried in a dielectric 7 can be formed, so the production of the ion wind generator 3 is easy.

The first electrode 9A and the second electrode 9B are the same in distance from the inner side electrode 11 (the distance between the first electrode 9A and the first downstream area (the shortest distance) and the distance between the second electrode 9B and the second downstream area (shortest distance) are the same as each other). Accordingly, ion winds having equivalent velocities can be generated at the first primary surface 7*a* and at the second primary surface 7*b*. As a result, for example, at the junction of the ion wind at the first primary surface 7*a* and the ion wind at the second primary surface 7*b*, unintended bias of the ion wind and so on are suppressed.

In the ion wind generating device 1, the first electrode 9A and second electrode 9B are exposed at the outside of the dielectric 7, while the power supply device 15 gives the reference potential to the first electrode 9A and the second electrode 9B and gives a potential fluctuating with respect to the reference potential to the inner side electrode 11.

Accordingly, at the exposed portions of the ion wind generator 3, fluctuation in the potential is suppressed, so safety is improved. In other words, the operability of the ion wind generating device 1 is improved.

Note that, in the above first embodiment, the first primary surface 7*a* and the second primary surface 7*b* are one example of the first surface and the second surface of the present invention, the positive side of the x-direction is one example of the first direction and the second direction, the whole of the inner side electrode 11 is one example of the first downstream area and the second downstream area of the inner side electrode, and the power supply device 15 is one example of the power supply of the present invention.

Second Embodiment

Figure 3:
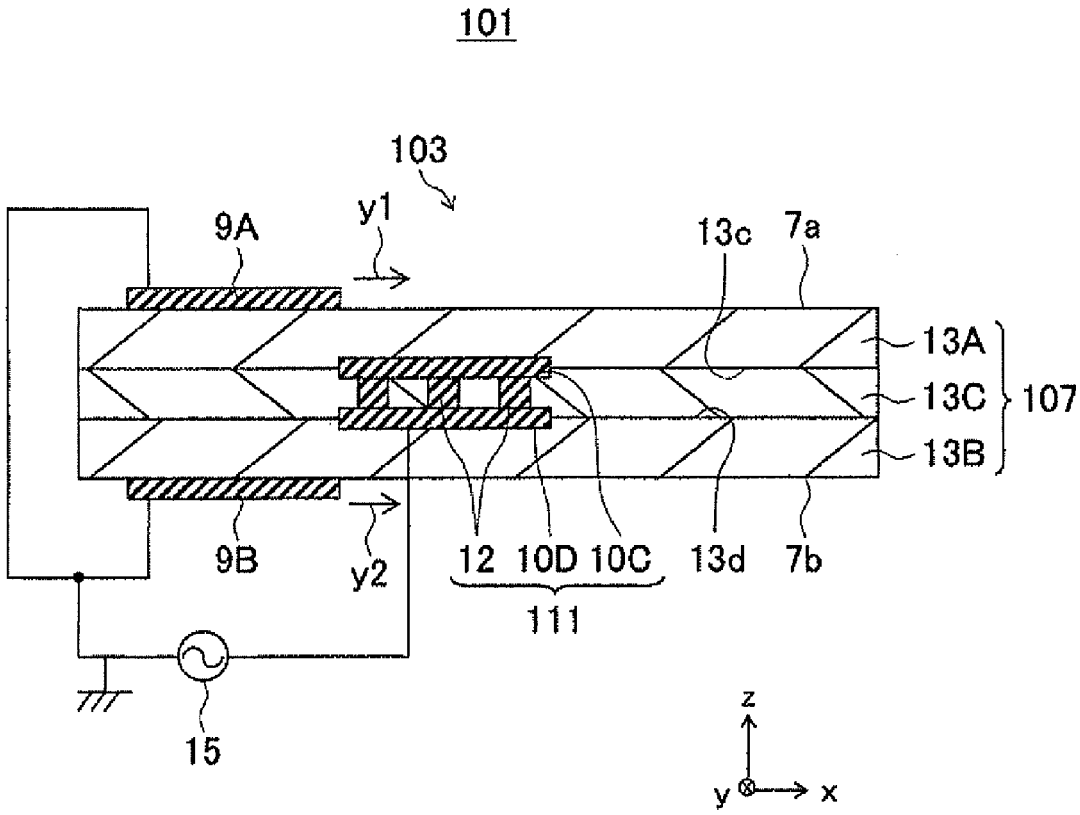
FIG. 3 A cross-sectional view schematically showing a principal part of an ion wind generating device according to a second embodiment of the present invention.

FIG. 3 is a cross-sectional view which schematically shows a principal part of an ion wind generating device 101 according to a second embodiment of the present invention.

The ion wind generating device 101 differs from the configuration of the first embodiment in the configuration of the dielectric 107 and the configuration of the inner side electrode 111 in the ion wind generator 103. Specifically, this is as follows.

The dielectric 107 is configured by lamination of a first insulation layer 13A, a second insulation layer 13B, and a third insulation layer 13C interposed between them. The first insulation layer 13A and the second insulation layer 13B may be the same in configuration as the first insulation layer 13A and second insulation layer 13B in the first embodiment. The third insulation layer 13C has roughly same configuration as that of the first insulation layer 13A and second insulation layer 13B as well. Note, the thickness of the third insulation layer 13C may be suitably set. FIG. 3 exemplifies a case where the third insulation layer 13C is formed thinner than the first insulation layer 13A and second insulation layer 13B.

The inner side electrode 111 has a third electrode 10C, a fourth electrode 10D, and via conductors 12. The third electrode 10C, fourth electrode 10D, and via conductors 12 are connected to each other and function as the inner side electrode 11 as a whole.

The third electrode 10C and the fourth electrode 10D may respectively be the same in configuration as the inner side electrode 11 in the first embodiment. Note, the third electrode 10C is arranged between the first insulation layer 13A and the third insulation layer 13C, and the fourth electrode 10D is arranged between the second insulation layer 13B and the third insulation layer 13C.

The via conductors 12 pass through the third insulation layer 13C to connect the third electrode 10C and fourth electrode 10D. The number, arrangement, planar shape, cross-sectional shape, and dimensions of the via conductors 12 may be suitably set. The material of the via conductors 12 is for example the same as the material of the layer shaped electrodes (9A, 9B, 10C, and 10D).

Figure 4:
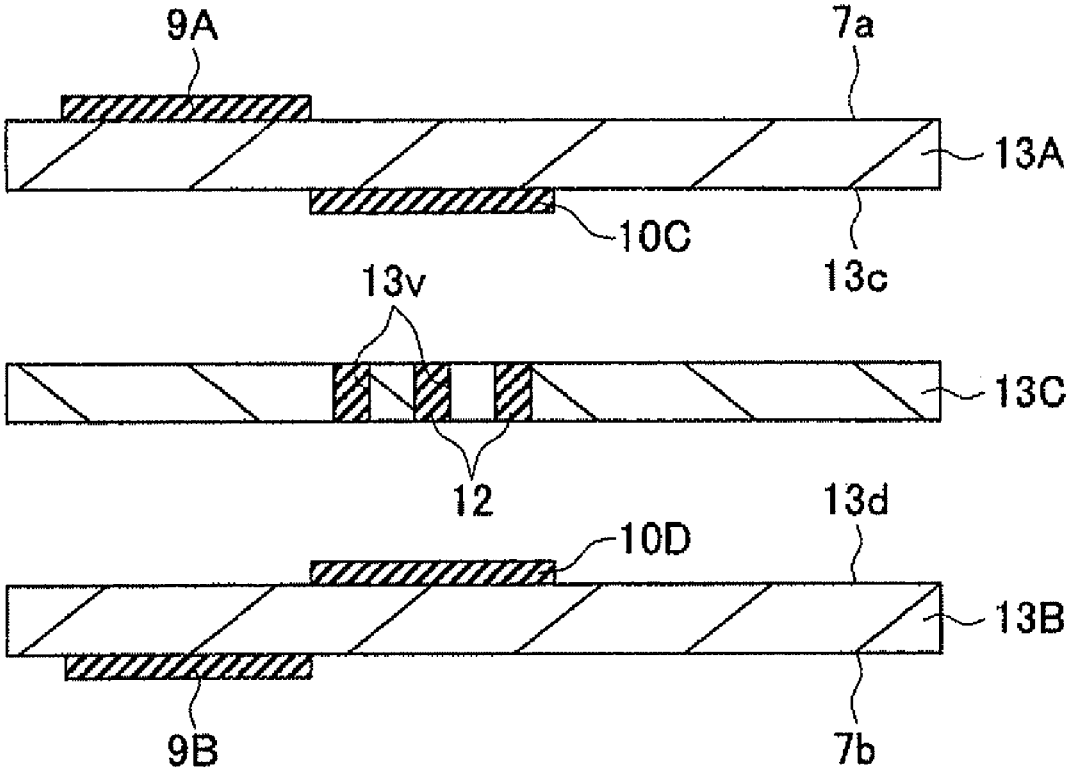
FIG. 4 A cross-sectional view for explaining a method of production of an ion wind generator in FIG. 3.

FIG. 4 is a schematic cross-sectional view for explaining the method of production of the ion wind generator 103.

The ion wind generator 103 is produced by lamination of insulation layers 13 at which various types of electrodes are arranged in the same way as the ion wind generator 3 in the first embodiment. As a concrete method of that, a method of laminating and firing ceramic green sheets on which conductive pastes are coated may be applied. This is the same as the first embodiment as well.

Note, the conductive paste which becomes the third electrode 10C is coated on the third primary surface 13*c* of the ceramic green sheet which becomes the first insulation layer 13A. That is, the conductive paste which becomes the third electrode 10C is coated on the ceramic green sheet on which the conductive paste which becomes the first electrode 9A is coated.

Further, the conductive paste which becomes the fourth electrode 10D is coated on the fourth primary surface 13*d* of the ceramic green sheet which becomes the second insulation layer 13B. That is, the conductive paste which becomes the fourth electrode 10D is coated on the ceramic green sheet to which the conductive paste which becomes the second electrode 9B is coated.

Further, the conductive paste which becomes the via conductors 12 is filled in vias 13*v* which are formed in the ceramic green sheet which becomes the third insulation layer 13C. Note that, as the method of forming the vias 13*v* and the method of filling the conductive paste, a known technique may be used.

Then, by laminating and firing three ceramic green sheets, the inner side electrode 11 configured by the third electrode 10C, fourth electrode 10D, and via conductors 12 are formed.

According to the above second embodiment, the same action and effects as those by the first embodiment are obtained. That is, by supplying voltage between the inner side electrode 11 and the first electrode 9A, as indicated by the arrow y1 in FIG. 3, ion wind along the first primary surface 7*a* can be generated. By supplying voltage between the inner side electrode 11 and the second electrode 9B, ion wind along the second primary surface 7*b* can be generated as indicated by the arrow y2 in FIG. 3. As a result, ion winds can be suitably generated at the two surfaces of the dielectric 7. The configuration can be streamlined and reduced in size by sharing the inner side electrode 11.

Further, the dielectric 107 has the first insulation layer 13A configuring the first primary surface 7*a* and the second insulation layer 13B configuring the second primary surface 7*b*. The first electrode 9A is provided at the first insulation layer 13A, and the second electrode 9B is provided at the second insulation layer 13B. The inner side electrode 11 has the third electrode 10C provided on the side nearer the second insulation layer 13B than the first electrode 9A at the first insulation layer 13A, the fourth electrode 10D provided on the side nearer the first insulation layer 13A than the second electrode 9B at the second insulation layer 13B, and the via conductors 12 connecting the third electrode 10C and the fourth electrode 10D.

Accordingly, the distance between the first electrode 9A and the inner side electrode 11 (first downstream area) is defined by the distance between the first electrode 9A and the third electrode 10C. In the same way, the distance between the second electrode 9B and the inner side electrode 11 (second downstream area) is defined by the distance between the second electrode 9B and the fourth electrode 10D. In other words, the two outer side electrodes 9 differ in the parts of the inner side electrode 11 which become the standard of the distance from the inner side electrode 11. As a result, for example, individual adjustment of velocities of the ion winds at the first primary surface 7*a* side and second primary surface 7*b* side is facilitated.

Further, in the ion wind generator 3 of the first embodiment, in order to make the velocity of the ion wind higher, if the distance between each outer side electrode 9 and the inner side electrode 11 is made smaller, that is, if the two insulation layers 13 are made thin, the thickness of the dielectric 7 as a whole becomes small as well, so the mechanical strength of the ion wind generator 3 is lowered. In the ion wind generator 103 of the present embodiment, however, even when the first insulation layer 13A and second insulation layer 13B are made thin, the thickness of the dielectric 107 as a whole can be secured and so on.

Further, in the first embodiment, as shown in FIG. 2, positional deviation occurs when superimposing the first insulation layer 13A and the second insulation layer 13B on each other. Consequently, positional error is liable to be caused between the first electrode 9A and the inner side electrode 11. As a result, for example, a difference is liable to be caused between the distance between the first electrode 9A and the inner side electrode 11 and the distance between the second electrode 9B and the inner side electrode 11. In the present embodiment, however, the positional deviation when superimposing three insulation layers 13 on each other does not influence the distance between the first electrode 9A and the inner side electrode 11 and the distance between the second electrode 9B and the inner side electrode 11. That is, the influence of error in the lamination process upon the velocity of the ion wind can be suppressed.

The dielectric 107 is a substrate configured by lamination of a plurality of (three in the present embodiment) flat sheet shape insulation layers 13. The first primary surface 7*a* and second primary surface 7*b* are the two surfaces of the substrate facing the lamination directions of the insulation layers 13. The plurality of insulation layers 13 have the first insulation layer 13A having the first primary surface 7*a* and the third primary surface 13*c* at the rear thereof, the second insulation layer 13B having the second primary surface 7*b* and the fourth primary surface 13*d* at the rear thereof, and the third insulation layer 13C interposed between the third primary surface 13*c* and the fourth primary surface 13*d*. The first electrode 9A is a layer-shaped electrode laminated at the first primary surface 7*a*, and the second electrode 9B is a layer-shaped electrode laminated at the second primary surface 7*b*. The third electrode 10C is a layer-shaped electrode laminated at the third primary surface 13*c*, and the fourth electrode 10D is a layer-shaped electrode laminated at the fourth primary surface 13*d*. Further, the via conductors 12 connecting the third electrode 10C and the fourth electrode 10D are conductors passing through the third insulation layer 13C.

Accordingly, in the same way as the first embodiment, the ion wind generator 10 has the same configuration as that of a multilayer circuit board. Various techniques used for multilayer circuit boards can be utilized. In particular, because of the dielectric 7 is configured by a ceramic, by utilizing art for ceramic multilayer boards, a ion wind generator 103 excellent in the mechanical strength, thermal strength, and electrical characteristics can be realized.

The first electrode 9A and the second electrode 9B are the same in distance from the inner side electrode 11 with respect to each other (the distance between the first electrode 9A and the first downstream area and the distance between the second electrode 9B and the second downstream area are the same as each other). In this case, the effect of suppressing error due to the positional deviation at the time of lamination explained above effectively acts. The reason for this is considered as follows. When making the wind velocities at the first primary surface 7*a* and at the second primary surface 7*b* the same as each other, compared with the case where the wind velocities are made different from each other, a high precision is frequently required in order to suppress the occurrence of an unintended fluid phenomenon.

Note that, in the above second embodiment, the first insulation layer 13A and second insulation layer 13B are one example of the first partial dielectric and second partial dielectric in the present invention, and the via conductors 12 are one example of the connection conductors in the present invention.

Third Embodiment

Figure 5A:
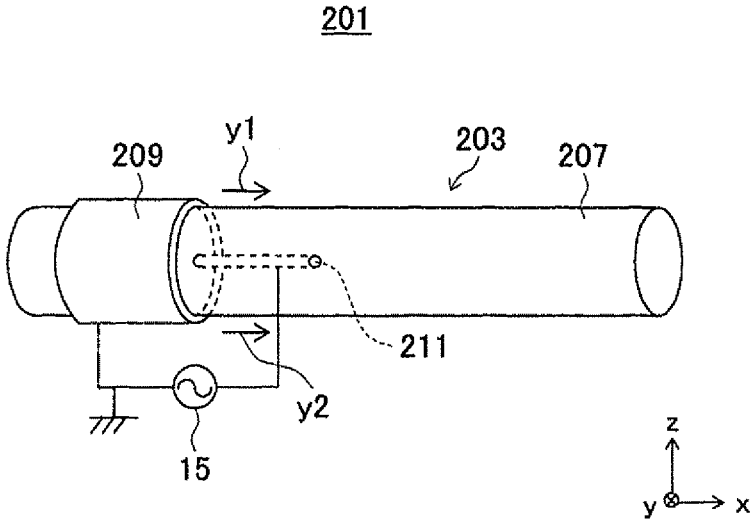
FIG. 5A and FIG. 5B are a perspective view and a front view which schematically show principal parts of an ion wind generating device according to a third embodiment of the present invention.
Figure 5B:
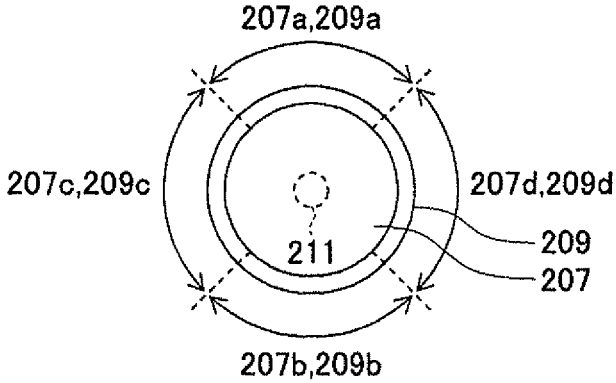

FIG. 5A is a perspective view schematically showing principal parts of an ion wind generating device 201 according to a third embodiment of the present invention. FIG. 5B is a front view when viewing an ion wind generator 203 of the ion wind generating device 201 in the x-axis direction.

The ion wind generating device 201 differs from the first embodiment in the configuration of the ion wind generator 203. Specifically, this is as follows.

A dielectric 207 is formed roughly in a columnar state. Further, an inner side electrode 211 is formed in an axial state which extends along the center line of the dielectric 207. An outer side electrode 209 is formed in a tubular state surrounding the outer circumferential surface of the dielectric 207. An inner side electrode 211 includes a downstream area located on one side in the axial direction of the dielectric 207 with respect to the outer side electrode 209 (the whole of the inner side electrode 211 in the present embodiment).

The cross-sectional view obtained by cutting the ion wind generator 203 parallel to the xz plane is the same as FIG. 1B except for the point that the dielectric 207 is not configured by two insulation layers 13. As understood from this, when voltage is supplied to the outer side electrode 209 and the inner side electrode 211, a dielectric barrier discharge occurs, and an ion wind flowing in the axial direction is generated around the outer circumferential surface of the dielectric 207.

Note that, as shown in FIG. 5B, it can be grasped that the dielectric 207 has a plurality of curved surfaces 207*a* to 207*d* facing directions which are different from each other. That is, the dielectric 207 has the curved surface 207*a* and the curved surface 207*b* at the rear thereof and has the curved surface 207*c* and the curved surface 207*d* facing sides of these curved surfaces.

Further, it can be grasped that the outer side electrode 209 has partial electrodes 209*a* to 209*d* which are individually provided at the curved surface 207*a* to the curved surface 207*d*.

Note that, it can be grasped too that the dielectric 207 has two curved surfaces (half cylinder surfaces) facing opposite directions with respect to each other. It can be grasped too that the outer side electrode 209 has two partial electrodes which are individually provided on those two curved surfaces.

According to the above third embodiment, the action and effects as those by the first embodiment are obtained. That is, by supplying voltage between the inner side electrode 211 and the outer side electrode 209, as indicated by the arrows y1 and y2 in FIG. 5A, ion winds can be preferably generated at the curved surfaces 207*a* to 207*d* facing directions different from each other, so the configuration can be simplified and made smaller in size by making common use of the inner side electrode 11.

Further, the ion wind generator 203 has a ring-shaped outer side electrode 209 which includes the partial electrodes 209*a* to 209*d* and is formed so as to surround the outer circumference of the dielectric 207. Accordingly, the ion wind generator 203 can generate ion wind over the entire circumference around a predetermined axis of the dielectric 207. As a result, for example, realization of a ion wind having large air flow by a small-sized configuration is expected.

Note that, in the third embodiment, any two among the curved surfaces 207*a* to 207*d* are one example of the first surface and second surface of the present invention, and any two among the partial electrodes 209*a* to 209*d* are one example of the first electrode and second electrode of the present invention.

Fourth Embodiment

Figure 6:
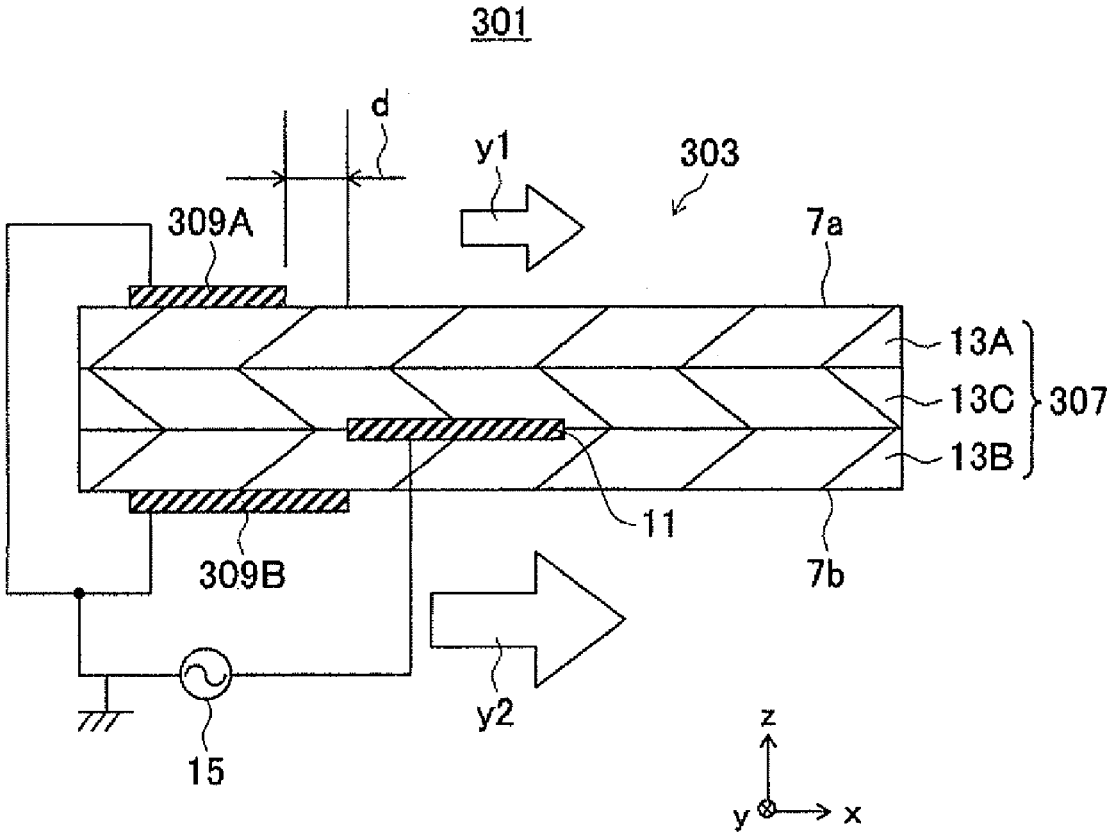
FIG. 6 A cross-sectional view which schematically shows principal parts of an ion wind generating device according to a fourth embodiment of the present invention.

FIG. 6 is a cross-sectional view which schematically shows principal parts of an ion wind generating device 301 according to a fourth embodiment of the present invention.

In the first embodiment, the ion wind generator 3 was configured so that the distance between the first electrode 9A and the inner side electrode 11 and the distance between the second electrode 93 and the inner side electrode 11 became equal. As opposed to this, in the fourth embodiment, the ion wind generator 303 is configured so that the distance between a first electrode 309A and the inner side electrode 11 (first downstream area) and the distance between a second electrode 309B and the inner side electrode 11 (second downstream area) are different from each other.

For example, the difference of the distances is realized by the difference of distances in the thickness direction (z). More specifically, for example, this is realized by making the number of insulation layers 13 interposed between the first electrode 309A and the inner side electrode 11 and the number of insulation layers 13 interposed between the second electrode 309B and the inner side electrode 11 different from each other. Note that, the thicknesses of the insulation layers 13 are for example the same as each other. Naturally, the difference of distances in the thickness direction can be realized by making the thicknesses of insulation layers 13 different as well in the case where the dielectric is configured by two insulation layers 13 as in the first embodiment.

Further, for example, the difference of the distances is realized by the difference of distances in the flow direction (x-direction). More specifically, for example, this is realized by making the positions of two outer side electrodes 309 different from each other by a predetermined distance d. Note that, in FIG. 6, the sizes of the two outer side electrodes 309 in the x-direction differ from each other. However, the sizes may be the same as each other as well.

In this way, by making the distance between the first electrode 309A and the inner side electrode 11 and the distance between the second electrode 309B and the inner side electrode 11 different from each other, it is made easier to make the ion winds individually generated at the first primary surface 7*a* and at the second primary surface 7*b* different. For example, even when the two outer side electrodes are connected parallel, each of the wind velocities at the first primary surface 7*a* and at the second primary surface 7*b* can be any wind velocity.

Fifth Embodiment

Figure 7:
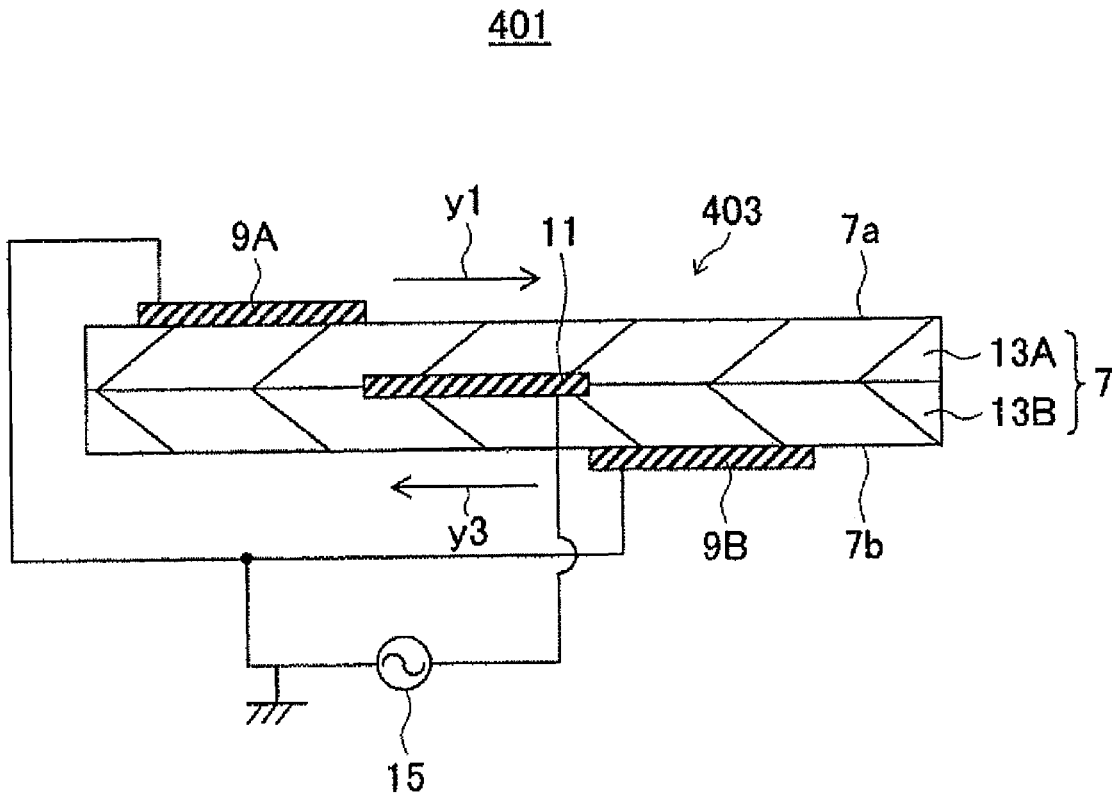
FIG. 7 A cross-sectional view which schematically shows principal parts of an ion wind generating device according to a fifth embodiment of the present invention.

FIG. 7 is a cross-sectional view which schematically show principal parts of an ion wind generating device 401 according to a fifth embodiment of the present invention.

In the first embodiment, the first electrode 9A and the second electrode 9B were offset in the same direction along the first primary surface 7*a* and second primary surface 7*b* with respect to the inner side electrode 11 (the direction which the first downstream area of the inner side electrode is located with respect to the first electrode 9A (the first direction) and the direction in which the second downstream area of the inner side electrode is located with respect to the second electrode 9B (the second direction) were the same direction). As opposed to this, in the present embodiment, the first electrode 9A and the second electrode 9B are offset in directions which are along the first primary surface 7*a* and second primary surface 7*b*, but are different from each other with respect to the inner side electrode 11 (the first direction and the second direction are directions different from each other). For example, the first electrode 9A and the second electrode 9B are offset in directions which are opposite to each other in the x-direction with respect to the inner side electrode 11 (the first direction and the second direction are opposite directions).

Accordingly, in the ion wind generator 403, as indicated by arrows y1 and y3, the ion winds flow in directions different from each other between the first primary surface 7*a* and the second primary surface 7*b* (opposite directions in the present embodiment). In this way, by adjustment of offset directions of the plurality of outer side electrodes 9 with respect to the inner side electrode 11, in accordance with the purpose of the ion wind generating device, flow directions of the ion winds along the surfaces different from each other can be suitably set.

Example of Utilization

Figure 8:
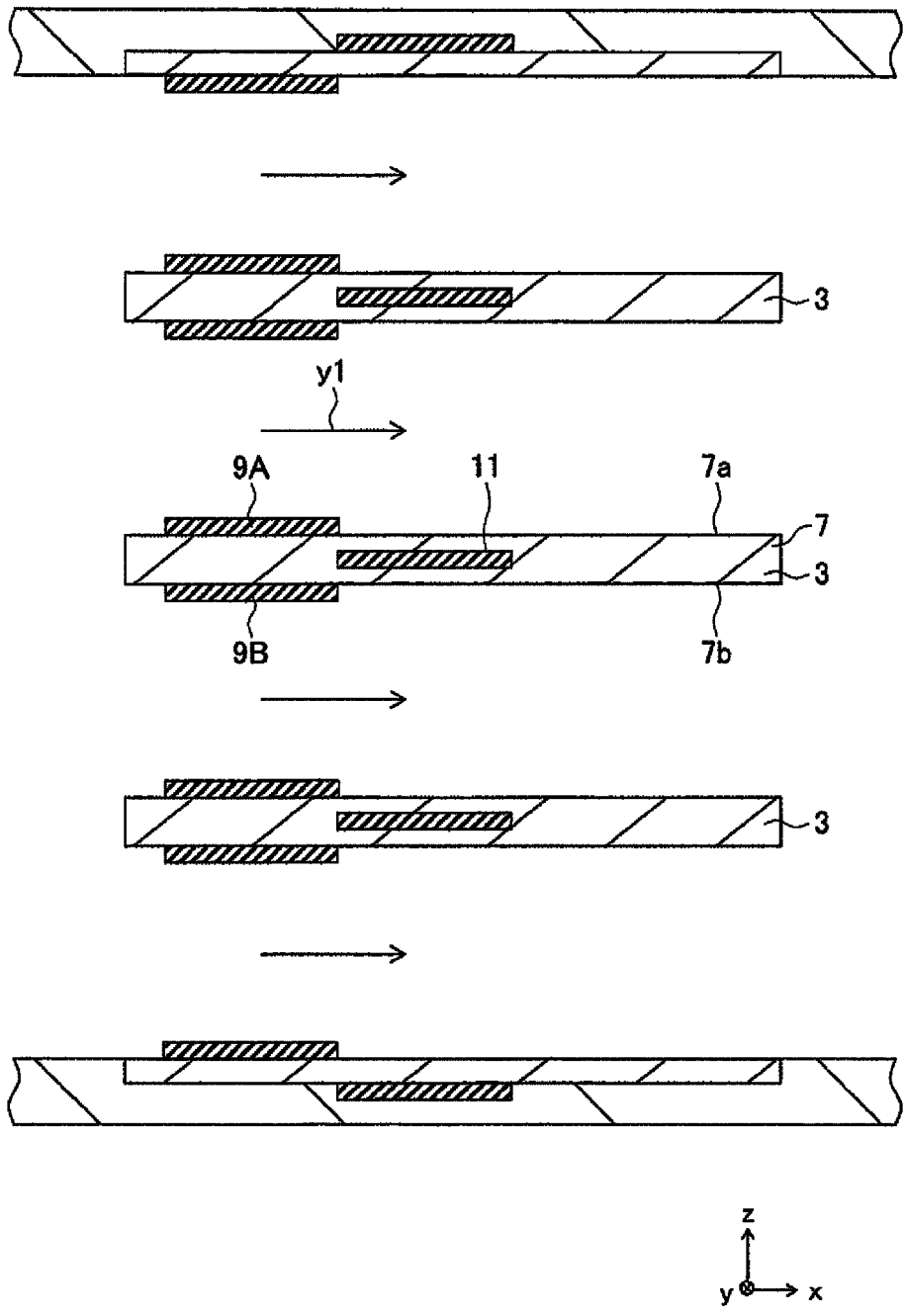
FIG. 8 A cross-sectional view which schematically shows principal parts of an example of utilization of the ion wind generating device in FIG. 1.

FIG. 8 is a cross-sectional view schematically showing a principal part of an example of utilization of the ion wind generating device 1 according to the first embodiment of the present invention.

FIG. 8 exemplifies a case where the ion wind generating device 1 is utilized in a reactor for modification of a fluid such as an exhaust gas or the like. In the passage of the fluid to be modified, a plurality of ion wind generators 3 are arranged in the width direction of the passage at predetermined intervals separated from each other. The ion wind generators 3 are arranged so that the flow direction of the ion winds is along the passage. Then, when voltage is supplied to the outer side electrodes 9 and the inner side electrodes 11, the plurality of ion wind generators 3 modify the fluid at both of their first primary surfaces 7*a* and second primary surfaces 7*b*, generate ion winds, and send out the fluids after modification.

The present invention is not limited to the above embodiments and may be executed in various aspects.

The ion wind generating devices and ion wind generators of the present invention can be utilized in a variety of fields. For example, the present invention may be utilized for suppressing separation of a boundary layer in a wing or may be utilized in formation of the flow in a small space (for example formation of cooling air in a compact electronic apparatus) as well.

As will be understood from the third embodiment (FIG. 5), the first surface and second surface of the dielectric which face directions different from each other are not limited to surfaces facing directions opposite to each other. The first surface and second surface may be surfaces facing directions perpendicular to each other as well or may be surfaces facing directions inclined with respect to each other as well. The shape of the dielectric is not limited to a thin rectangular parallelepiped or columnar state either and may be a suitable shape.

The dielectric is not limited to one formed by lamination of insulation layers. For example, the dielectric may be one formed by filling the material which forms the dielectric in a mold in which metal forming the electrode is arranged. Further, in a case where the dielectric is formed by lamination of insulation layers, the dielectric is not limited to one obtained by laminating and firing ceramic green sheets. For example, the dielectric may be one obtained by lamination of insulation layers by thermal spraying of a ceramic or may be one obtained by lamination and hot pressing of uncured thermosetting resin.

The shapes and numbers of the first electrode and second electrode (outer side electrodes) and inner side electrode may be suitably set. For example, in the first embodiment, one of the outer side electrodes and inner side electrode may be formed into a triangular shape or corrugated shape, and the distance between the outer side electrodes and the inner side electrode in the x-direction may change according to the position of the ion wind in the width direction. Further, for example, in the first embodiment, one of the outer side electrodes and inner side electrode may be divided into a plurality of electrodes in the width direction of the ion wind, and voltage may be controlled for each of those divided electrodes.

As will be understood from the second and third embodiments (FIG. 3 and FIG. 5), the inner side electrode is not limited to a layer shaped electrode. Further, the first electrode and second electrode (outer side electrodes) are not limited to the layer shaped electrodes either. For example, in the first embodiment, the first electrode and second electrode may be axial electrodes extending in the y-direction.

The first electrode and second electrode (outer side electrodes) may be arranged on the surface side of the dielectric with respect to the inner side electrode and do not have to be exposed at the surface of the dielectric. Further, when the outer side electrode is exposed at the surface of the dielectric, the outer side electrode is not limited to one arranged on the surface of the dielectric. For example, the outer side electrode may be fitted in a concave portion formed in the dielectric. Only a portion may be exposed from the dielectric as well. Further, the first electrode and second electrode (outer side electrodes) may be fixed to a member which is different from the dielectric and separated from the dielectric as well.

The offset directions of the first electrode and the second electrode with respect to the inner side electrode (the first direction and second direction from another viewpoint) are not limited to the same direction or opposite directions, but may be directions perpendicular to each other or directions inclined from each other as well.

As already explained, the first downstream area or second downstream area is not limited to the whole of the inner side electrode and may be a portion of the inner side electrode. In this case, at the inner side electrode, the first downstream area and second downstream area may be ranges which do not overlap each other or may be ranges where they partially overlap, but are different from each other.

The first electrode and second electrode are not limited to ones which are connected in parallel. For example, the first electrode and second electrode may be connected in series as well. Further, for example, by giving the reference potential to the inner side electrode and giving fluctuating potentials which are different in frequency and/or amplitude to the first electrode and the second electrode, the first electrode and the second electrode may be individually controlled in voltage as well.

The dielectric having the first and second partial dielectrics (13A and 13B in the embodiment) exemplified in the second embodiment (FIG. 3) is not limited to one formed by flat sheet shape insulation layers. Further, the first partial dielectric and second partial dielectric may be fixed to each other by suitable fixing member such as solder or the like in a state where they face each other with a suitable spacer between them.

Further, the connection conductors (the via conductors 12 in the embodiment) which connect the third and fourth electrodes which are provided at the first and second partial dielectrics are not limited to via conductors. For example, in the second embodiment, the conductors may be arranged at the sides of the third insulation layer 13C to configure the connection conductors.

REFERENCE SIGNS LIST

1 . . . ion wind generating device, 3 . . . ion wind generator, 7 . . . dielectric, 7*a* . . . first primary surface (first surface), 7*b* . . . second primary surface (second surface), 9A . . . first electrode, 9B . . . second electrode, 11 . . . inner side electrode (first downstream area, second downstream area), and 15 . . . power supply device (power supply).

The invention claimed is:

1. An ion wind generator comprising:

a dielectric having a first surface and a second surface which face opposite directions with respect to each other, an inner side electrode arranged in the dielectric, a first electrode which is arranged on the first surface side of the dielectric with respect to the inner side electrode, and a second electrode which is arranged on the second surface side of the dielectric with respect to the inner side electrode, wherein the inner side electrode has a first downstream area located in a first direction along the first surface with respect to the first electrode and can induce an ion wind along the first surface by application of voltage with the first electrode and has a second downstream area located in a second direction along the second surface with respect to the second electrode and can induce an ion wind along the second surface by application of voltage with the second electrode, wherein:

the dielectric has a first partial dielectric forming the first surface and a second partial dielectric forming the second surface, the first electrode is provided at the first partial dielectric, the second electrode is provided at the second partial dielectric, and the inner side electrode has a third electrode provided on the side of the first partial dielectric that is nearer the second partial dielectric than the first electrode, a fourth electrode provided on the side of the second partial dielectric that is nearer the first partial dielectric than the second electrode, and connection conductors connecting the third electrode and the fourth electrode.

2. An ion wind generator comprising:

a dielectric having a first surface and a second surface which face opposite directions with respect to each other, an inner side electrode arranged in the dielectric, a first electrode which is arranged on the first surface side of the dielectric with respect to the inner side electrode, and a second electrode which is arranged on the second surface side of the dielectric with respect to the inner side electrode, wherein the inner side electrode has a first downstream area located in a first direction along the first surface with respect to the first electrode and can induce an ion wind along the first surface by application of voltage with the first electrode and has a second downstream area located in a second direction along the second surface with respect to the second electrode and can induce an ion wind along the second surface by application of voltage with the second electrode, wherein the first direction and the second direction are the same direction, and, wherein:

the dielectric has a first partial dielectric forming the first surface and a second partial dielectric forming the second surface, the first electrode is provided at the first partial dielectric, the second electrode is provided at the second partial dielectric, and the inner side electrode has a third electrode provided on the side of the first partial dielectric that is nearer the second partial dielectric than the first electrode, a fourth electrode provided on the side of the second partial dielectric that is nearer the first partial dielectric than the second electrode, and connection conductors connecting the third electrode and the fourth electrode.

3. The ion wind generator as set forth in claim 1, wherein:

the dielectric is a substrate formed by lamination of a plurality of insulation layers of a flat sheet shape, the first surface and the second surface are both primary surfaces of the substrate, the plurality of insulation layers include a first insulation layer as the first partial dielectric having the first surface and a third surface at the rear thereof, a second insulation layer as the second partial dielectric having the second surface and a fourth surface at the rear thereof, and a third insulation layer interposed between the third surface and the fourth surface, the first electrode is a layer shaped electrode laminated at the first surface, the second electrode is a layer shaped electrode laminated at the second surface, the third electrode is a layer shaped electrode laminated at the third surface, the fourth electrode is a layer shaped electrode laminated at the fourth surface, and the connection conductors are via conductors passing through the third insulation layer.

* * * * *